US005813542A

United States Patent [19]

Cohn

[11] Patent Number: 5,813,542

[45] Date of Patent: Sep. 29, 1998

[54] COLOR SORTING METHOD

[75] Inventor: Avi P. Cohn, Lake Oswego, Oreg.

[73] Assignee: Allen Machinery, Inc., Newberg, Oreg.

[21] Appl. No.: 627,359

[22] Filed: Apr. 5, 1996

[51] Int. Cl.[6] ..... B07C 5/00

[52] U.S. Cl. ..... 209/581; 209/580; 209/587; 209/939; 356/406

[58] Field of Search ..... 209/580–582, 209/587, 939; 356/402, 406, 407

[56] References Cited

U.S. PATENT DOCUMENTS

| | | |
|---|---|---|
| Re. 29,031 | 11/1976 | Irving et al. . |
| Re. 33,357 | 9/1990 | Randall . |
| 2,881,919 | 4/1959 | Bartlett . |
| 3,066,797 | 12/1962 | Fraenkel . |
| 3,770,111 | 11/1973 | Greenwood et al. . |
| 3,993,899 | 11/1976 | Chapman . |
| 4,057,146 | 11/1977 | Castaneda et al. . |
| 4,120,402 | 10/1978 | Swanson . |
| 4,131,540 | 12/1978 | Husome et al. . |
| 4,132,314 | 1/1979 | von Beckman et al. . |
| 4,170,306 | 10/1979 | Marshall et al. . |
| 4,204,950 | 5/1980 | Burford, Jr. . |
| 4,205,752 | 6/1980 | Malvick et al. . |
| 4,246,098 | 1/1981 | Conway et al. . |
| 4,278,538 | 7/1981 | Lawrence et al. . |
| 4,334,782 | 6/1982 | Thornton, Jr. et al. . |
| 4,454,029 | 6/1984 | Codding . |
| 4,470,702 | 9/1984 | Matsumoto et al. . |
| 4,476,982 | 10/1984 | Paddock et al. . |
| 4,515,275 | 5/1985 | Mills et al. . |
| 4,726,898 | 2/1988 | Mills et al. . |
| 4,834,541 | 5/1989 | Yamaba . |
| 4,916,531 | 4/1990 | Genz et al. . |
| 5,021,645 | 6/1991 | Satula et al. . |
| 5,078,258 | 1/1992 | van der Schoot . |
| 5,085,325 | 2/1992 | Jones et al. . |
| 5,156,278 | 10/1992 | Aaron et al. . |
| 5,159,185 | 10/1992 | Lehr . |
| 5,265,732 | 11/1993 | Long . |
| 5,339,963 | 8/1994 | Tao . |
| 5,432,545 | 7/1995 | Connolly ..... 209/580 X |
| 5,533,628 | 7/1996 | Tao ..... 209/580 |

OTHER PUBLICATIONS

Computer Graphics Principles and Practice, Second Edition, by James D. Foley, Andries van Dam, Steven K. Feiner, John F. Hughes.

Bt281 27 MHz Programmable Color Space Converter and Color Corrector article (2 pages).

*Primary Examiner*—Boris Milef

*Attorney, Agent, or Firm*—Chernoff, Vilhauer, McClung & Stenzel, LLP

[57] ABSTRACT

A method of classifying objects comprises the steps of sensing a multiple color image of at least a portion of the object and producing color signals indicative of a plurality of colors in response to sensing the multiple color image. The color signals are transformed to a hue signal and a saturation signal, and the object is classified in response to the hue signal and the saturation signal.

64 Claims, 7 Drawing Sheets

FIG. 6A
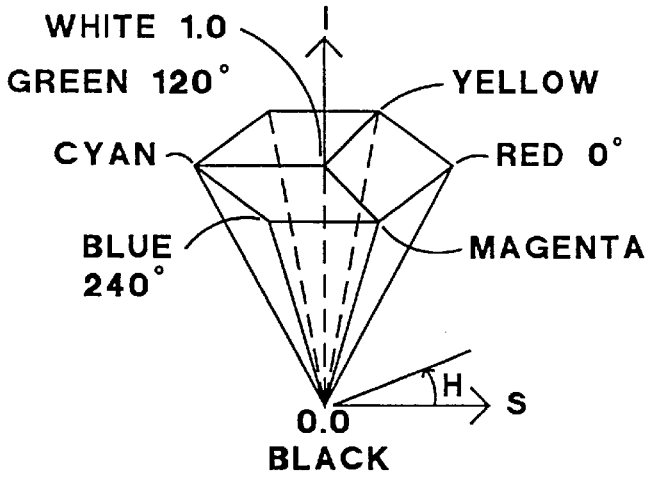
FIG. 6B
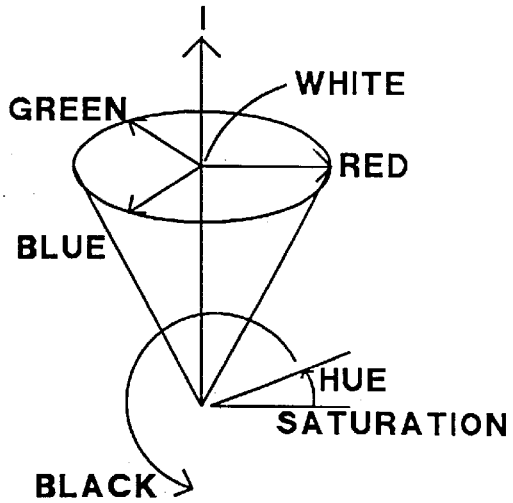
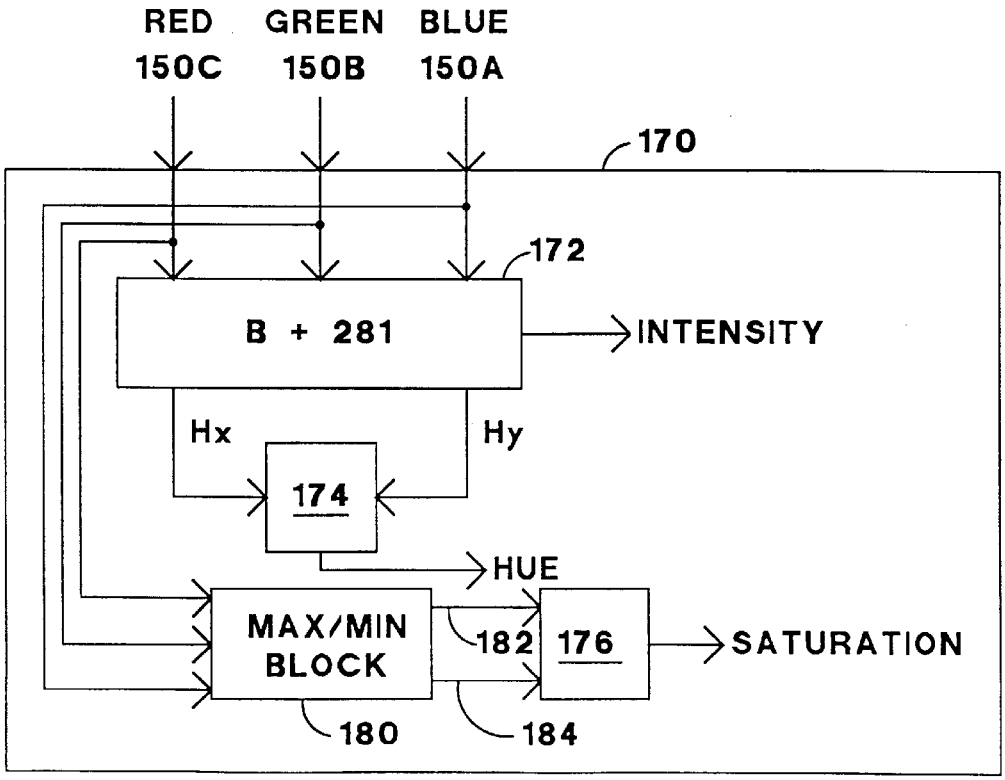
FIG. 7

COLOR SORTING METHOD

BACKGROUND OF THE INVENTION

The present invention relates to a method for sorting objects by color.

Sorters with a single color camera, known as monochromatic sorters, detect light intensity variations reflected from objects being sorted. By varying the color of the lighting system, the camera can distinguish between a limited range of colors and shades within a color. However, a single color camera can not effectively sort objects where the color variation between an object that should be accepted and an object that should be rejected is in more than one color domain.

Sorters with a multiple color camera system are used to sort objects which have colors in more than one color domain. Multiple color sorters traditionally use two or three different monochromatic cameras measuring the absolute light intensity reflectance from objects at two or three different colors, respectively. Red, green, and blue colors are frequently used because any color can be defined in terms of its red, green and blue color content. However, the human eye does not perceive an object's color in terms of its red, green, and blue color content. Therefore, color sorter operators must be highly skilled to properly adjust the magnitudes of the red, green, and blue colors to properly sort objects.

If a color sorter system were capable of detecting as many as 256 different intensities with each of the red, green, and blue cameras, and if each camera has 2048 linearly arranged pixels, then 24 billion different data combinations (256*256*256*2048) would need to be analyzed every scan. It is not feasible to analyze 24 billion data combinations at high speeds with current computers. Accordingly, color sorter systems are designed to be generally insensitive to light intensity variations in order to maintain a manageable number of different data combinations to analyze.

However, insensitivity to variations in the light intensity is a major limitation in current color sorting systems, making it difficult to identify particular colors consistently across the view of the camera. The light intensity variation is primarily due to three main factors. The first factor is distance. For example, the distance from the camera to the center of the viewing zone is different than the distance to the outer edges of the viewing zone, resulting in variations in the light intensity reaching the camera from objects of identical color. Also, variations in the sizes of the objects will vary the distances to the camera, so that larger objects result in a higher intensity than smaller objects of the same color. Distortion in the camera lens can also amplify the light intensity variation. Second, the light source has intensity variations due to aging, different temperatures, and uneven light distribution across the light source. Third, the optical path includes several elements susceptible to the accumulation of dust, dirt, or water, degrading the optical path's ability to transmit and detect light. The optical elements include a light source, an object reflecting the light, a viewing window on the camera, a camera lens, and a light sensor.

Current color sorter systems use an intensity-dependent absolute value of the red, green, and blue sensed colors to determine whether the product or object is acceptable. However, if the intensity of the light reaching the camera changes, the absolute value of the red, green, and blue sensed colors will also change. Changes in observed light intensity causes the color sorter system to presume a different color has been observed, while in reality merely the intensity of the observed light has changed. For example, if one observed light intensity is red=10, green=20, and blue=30, and another is red=20, green=40, and blue=60, the color sorter system will presume they are different colors. However, both sets of observed color signals refer to the same composite color.

Tao, U.S. Pat. No. 5,339,963 discloses a color sorting apparatus with a singulator section, a color sorter, and a conveyor which drops sorted objects into the appropriate collection bin. The function of the singulator section is to align objects in predefined lanes in order to distinguish between different objects. However, this limits the ability to convey a large number of objects at high speeds. A set of three aligned color cameras produce red, green, and blue signals of each object as it passes within view on the singulator section. Tao teaches that each object is individually imaged and the red, green, and blue signals are converted to obtain a single average hue value for the entire object that is used to sort the object. Calculating a single hue value for each object reduces the effects of optical noise, stray signals, and misalignment of the object. However, a single hue value for each object considerably reduces the sensitivity of the color sorter to detecting small defects.

Any rotation of the objects between the three aligned cameras results in an error because the respective pixels of each camera are not viewing the same portion of the object. Accordingly, to minimize the rotation of objects between cameras the sorting speed is limited.

Tao teaches that most fruits have a range of hues from the red to green color range, so the conversion of the red, green, and blue color signals is limited to the red to green hue range to reduce the processing requirements of the sorter system. However, the elimination of blue hues reduces the range of colors that can be effectively sorted. Further, the elimination of the blue hues results in a sorting system that is incapable of obtaining saturation and intensity values which may be useful to improve color recognition.

Tao's conversion of the red, blue, and green color signals to the hue value results in a hue value that is either in the first quadrant of a Cartesian coordinate system enhancing red colors, or the second quadrant enhancing yellow-green colors. The quadrant is operator selected by choosing the appropriate transformation equation based on the anticipated colors of objects to be sorted. However, if objects have more than one color, or if multiple objects with different colors are simultaneously being sorted, then the conversion may enhance inappropriate colors.

What is desired, therefore, is a color sorting system based, at least in part, on the hue of an object so that operators may easily adjust the sorting criteria. The hue values should extend beyond the red to green color range in order to sort objects encompassing a broader color range. In addition, color saturation values and, in some cases, intensity values should preferably be used to enhance color recognition. The color sorting system should also be insensitive to light intensity variations. The speed and number of objects capable of being sorted should be maximized, while simultaneously minimizing errors from rotational movement of objects between cameras. Further, the sorting system should be capable of detecting small blemishes and enhancing the appropriate colors.

SUMMARY OF THE PRESENT INVENTION

The present invention overcomes the foregoing drawbacks of the prior art by providing a method of classifying objects comprising the steps of sensing a multiple color image of at least a portion of the object and producing color signals indicative of a plurality of colors in response to sensing the multiple color image. The color signals are transformed to a hue signal and a saturation signal, and the object is classified in response to the hue signal and the saturation signal.

Preferably a memory contains data representative of the hue and saturation values, and the classification of the object is based on a comparison of the hue signal and the saturation signal to the data. By classifying the object in response to the hue signal and the saturation signal, more accurate color recognition can be made in order to properly classify an object. With only two signals to be analyzed the data processing requirements are reduced in comparison to processing three signals.

In another aspect of the present invention the objects are randomly positioned across the view of the camera. The color signals are transformed to a hue signal and the object is classified in response to the hue signal. Randomly positioned objects allow the conveyor to process a large number of objects quickly. In the preferred embodiment, the color signals are also transformed to a saturation signal and the classification is based on both the hue and saturation signals.

In another aspect of the present invention the multiple color image is of the same minor portion of an object. A set of color signals is produced from this image and transformed to a set of values, including at least one value representative of at least one of a hue signal and a saturation signal. The object is classified in response to the set of values. By classifying the object based on a minor portion of a single object, small blemishes can be detected on the object which would be otherwise overlooked if a single value was determined for the entire object.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 6 is a block diagram of the converter of FIG. 4.

FIG. 7 is a diagrammatic representation of a HSI model space.

DETAILED DESCRIPTION OF THE INVENTION

Figure 1:
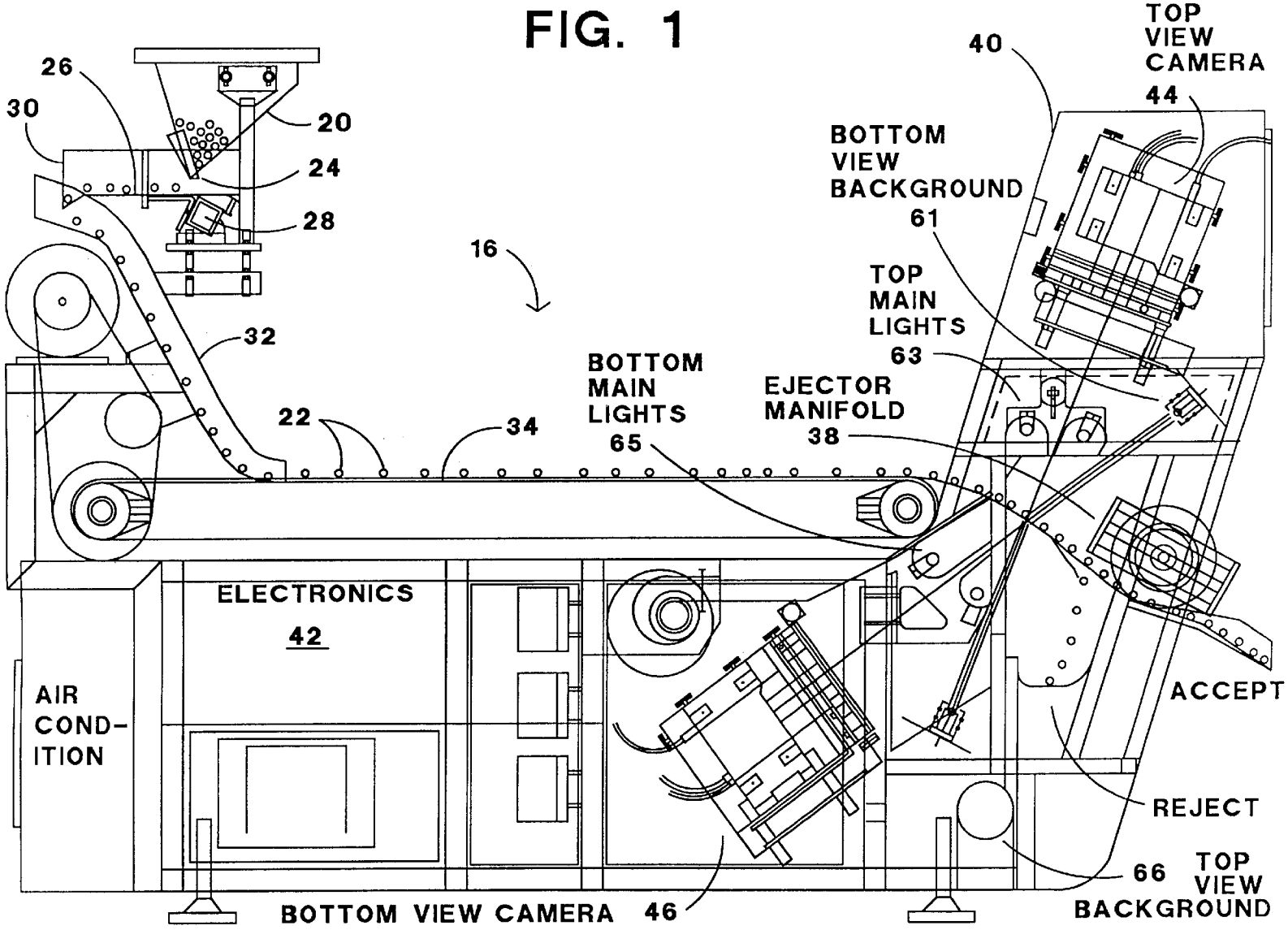
FIG. 1 is a side view of an exemplary color sorter system including a conveyor system, a camera section including two three-color cameras, electronics, and an ejector manifold.

Referring to FIG. 1, a sorting system 16 includes a hopper 20 that stores objects 22 to be sorted. Preferably the objects 22 are granular in nature, such as peanuts, rice, peas, etc. However, with appropriate modifications to the sorting system 16 other types of objects may be sorted, such as, for example, fruit and vegetables. The objects 22 are dispensed through a lower opening 24 in the hopper 20 onto a tray 26. A vibrator 28 vibrates the tray 26 separating the objects 22 from one another producing an even flow of objects 22 along the tray 26. The objects 22 fall off the end 30 of the tray 26 into an acceleration chute 32. The acceleration chute 32 increases the speed of objects 22 to approximately match the speed of a rotating continuous conveyor belt 34. Matching the speed of the objects 22 exiting the acceleration chute 32 to the speed of the conveyor belt 34 reduces the time and distance to stabilize objects 22 on the belt 34. The objects 22 are transported along the conveyor belt 34 and launched in a trajectory through a camera section 40. The camera section 40 senses a multiple color image of the objects 22 and produces color signals indicative of a plurality of colors. The color signals are transmitted to the electronics 42 to determine if the imaged objects 22 are acceptable or should be rejected. The electronics 42 controls a fluid nozzle ejector manifold 38 to sort the objects 22 into either an accept or reject bin by deflecting rejected objects from their normal trajectory. The preferred ejector manifold is described in U.S. Pat. No. 5,339,965, assigned to the same assignee and incorporated herein by reference. Alternatively, the conveyor system 16 could grade and sort the objects into one of multiple bins.

Figure 2:
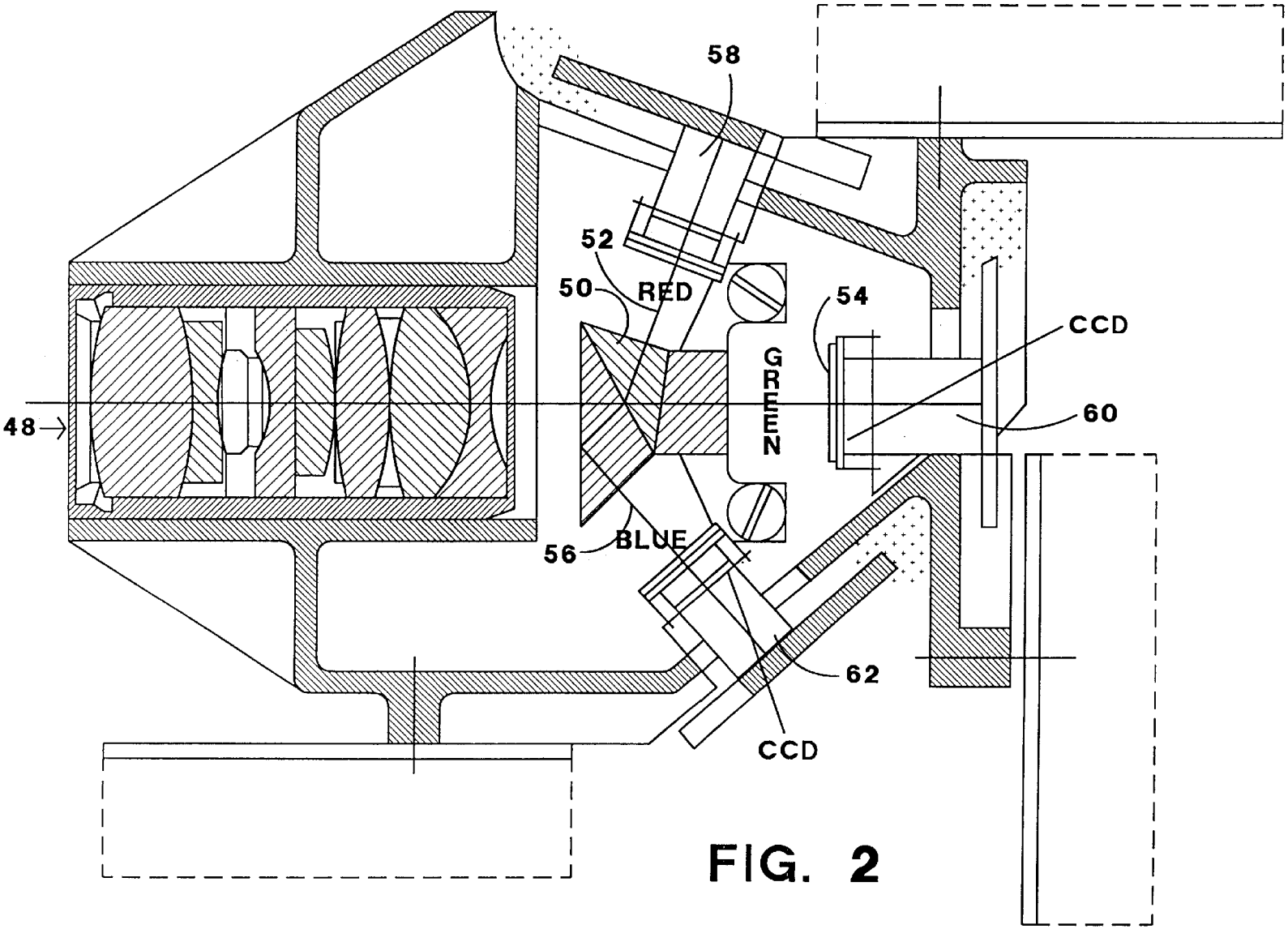
FIG. 2 is a sectional view of one of the three-color cameras of FIG. 1.

The camera section 40 includes a top view camera 44 and a bottom view camera 46, both of which are preferably identical, to simultaneously view two sides of the objects 22 across the view of the cameras 44 and 46. Referring to FIG. 2, the top view camera 44 and bottom view camera 46 receive light reflected off objects 22 through a frontal lens assembly 48. The received light is separated by a dichroic prism 50 into its red 52, green 54, and blue 56 components. The red 52, green 54, and blue 56 components are directed onto a respective one of three charge coupled devices (CCD's) 58, 60, and 62. Each of the charge-coupled devices is preferably a linear array of charge-coupled pixels. Alternatively, the charge-coupled devices could be a two dimensional array. The charge coupled devices 58, 60, and 62 are aligned in three directions, namely, x, y, z, to ensure that corresponding pixels on each charge-coupled device refer to the identical portion of each object 22. Moreover, cameras 44 and 46 are arranged to view their respective sides of all objects 22 simultaneously. Accordingly, the cameras 44 and 46 will view each object at the same time, which eliminates errors otherwise induced by rotation of objects as they pass between successive fields of view of multiple cameras. By eliminating the source of the rotational error, the belt 34 speed may be increased to sort objects faster.

A suitable camera is available from Dalsa, 605 McMurray Road, Waterloo, Ontario, Canada, N2V2E5. Each charge coupled device 58, 60, and 62 may have any suitable resolution, such as 2048 pixels. The camera produces an analog signal from each pixel of each charge coupled device 58, 60, and 62 that is proportional to the intensity of light striking the respective pixel. Accordingly, a set of red, blue, and green color signals is produced for each corresponding set of three pixels on the charge coupled devices 58, 60 and 62. A line-by-line image of portions of the objects 22 is obtained as they move past the view of the cameras.

An alternative camera arrangement is three separate linear cameras spaced apart from each other along the direction of travel of the objects 22. Each camera is selected to sense a particular color, namely, red, blue, and green. The three linear cameras are preferably spaced sufficiently close together in order to minimize both the sideways movement of objects between the cameras and any rotational movement between cameras. The close arrangement of the cameras increases the likelihood that the same portion of each object is viewed by corresponding sensors on each camera. A time delay between the sensing of each camera is incorporated into the color sorter system to compensate for the time necessary for objects to travel between the cameras. If significant errors are still introduced by sideways or rotational movement between the cameras, a prism can be located in front of the cameras so that the same portion of each object is viewed at the same time by each camera.

It is to be understood that any number and type of camera system may be employed to obtain multiple color images of at least a portion of one or more objects to be sorted or otherwise classified. The number, type, and range of colors is selected so as to be suitable for the particular objects and subsequent signal processing employed. The colors may include any wavelength, such as x-ray, ultraviolet light, and infrared.

Referring again to FIG. 1, a top main light 63 and a bottom main light 65 include a florescent or quartz-halogen lamp to illuminate respective sides of the objects 22 imaged by the cameras 44 and 46. A bottom view background 64 and a top view background 66 are aligned within the viewing area of the respective cameras 44 and 46, so that the light detected in regions between the objects 22 has a known intensity and color. Such intensity and color are adjusted so that the reflections from the backgrounds 64 and 66 match the intensity and color of light reflected from an acceptable product or object. Accordingly, the light received from regions between adjacent objects is interpreted as acceptable objects. Otherwise, the sorter system 16 may interpret the regions between adjacent objects as unacceptable objects.

Figure 3:
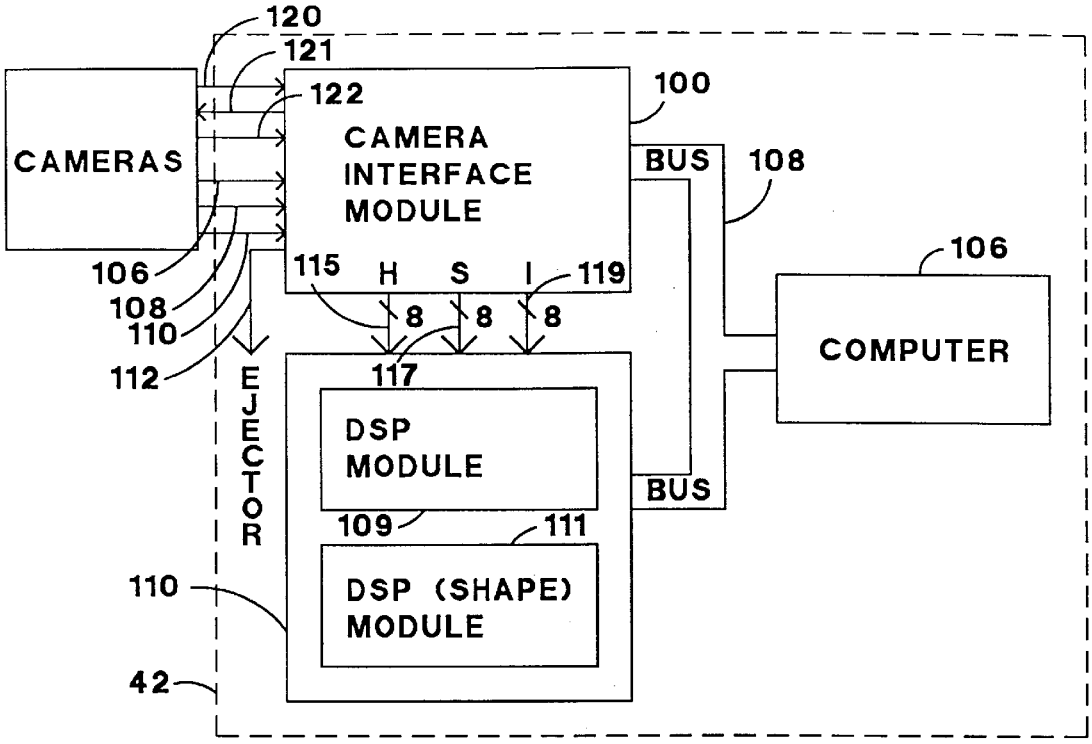
FIG. 3 is a block diagram of the electronics of FIG. 1 including a camera interface module.

Referring to FIG. 3, the electronics 42 include a camera interface module 100 which processes the color signals from the cameras. One or more cameras may interface with the camera interface module 100. Each camera transmits red 106, blue 108, and green 110 color signals to the camera interface module 100. The cameras and camera interface module 100 communicate with each other via a valid video in 120, start 121, and clock out 122. Each of the color signals 106, 108, and 110 are preferably analog in nature and transmitted on a separate line. However, the color signals 106, 108, and 110 may be in any other form, such as digital, or combined together in one or more composite signals. The color signals could be transmitted from the cameras to the electronics 42 by other methods, such as for example, mechanical, optical, or a radio transmitter-receiver.

The camera interface module 100 is controlled by a computer 106 via a bus 108. A digital signal processor module 110 has one or more digital signal processors 109, and 111 to provide added signal processing capabilities, if necessary. For example, such signal processing may include determining the density, shape, and size of objects. The camera interface module 100 is interconnected with the digital signal processor module 110 with three lines, namely, a hue line 115, a saturation line 117, and an intensity line 119. One or more control lines 112 interconnect the camera interface module 100 and the ejector manifold 38 to sort objects 22.

Figure 4:
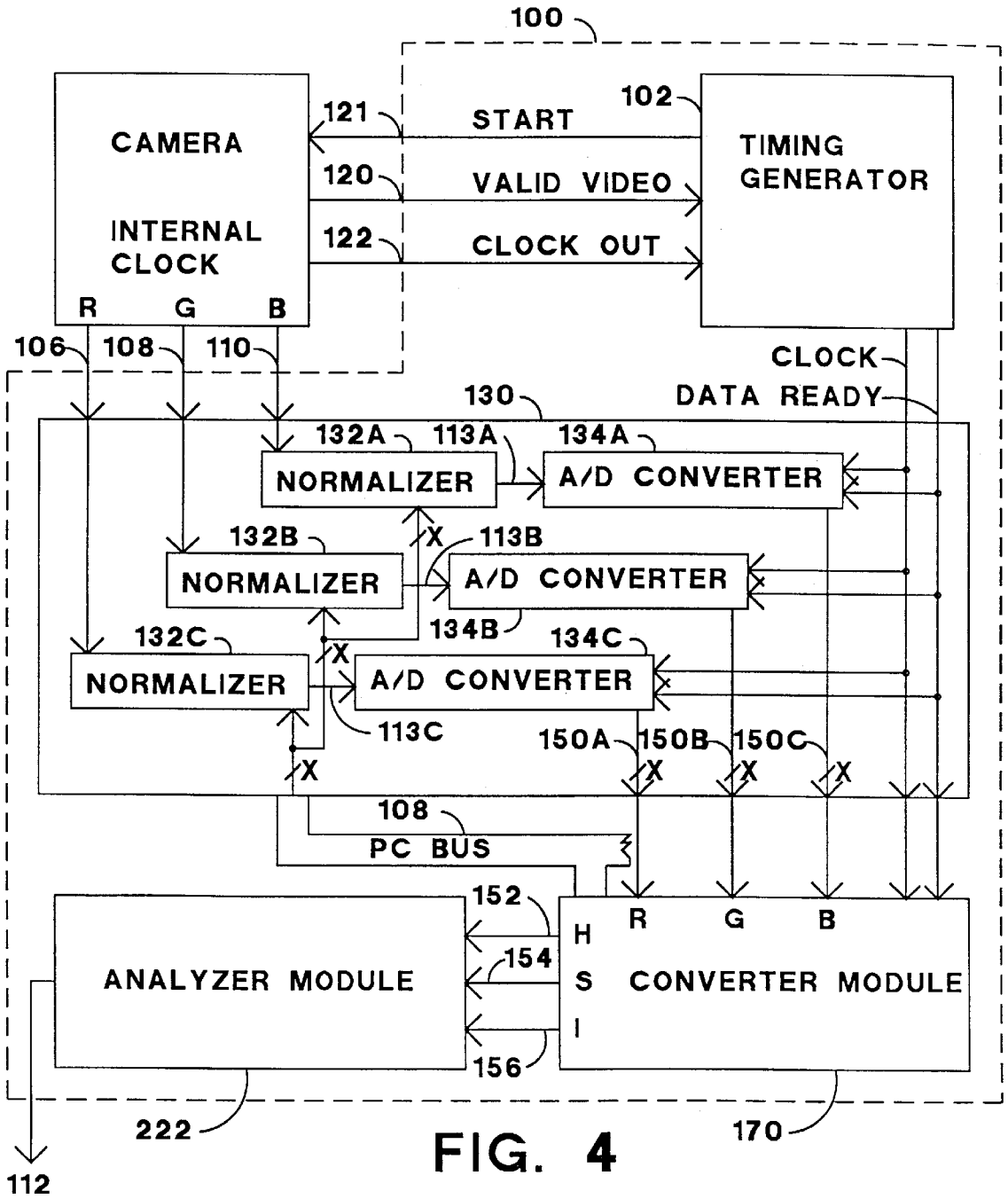
FIG. 4 is a block diagram of the camera interface module of FIG. 3, including a normalizer, a converter, and an analyzer.

Referring to FIG. 4, the camera interface module 100 includes a timing generator (TG) module 102. The TG module 102 initiates a camera scan via the start signal 121. The camera(s) in turn respond by returning a valid video signal 120, a synchronizing clock output 122 and three video signals, red 106, green 108, and blue 110. The TG module 102 controls when the sensing of objects is done, and the transmission of color signals from the camera to the camera interface module 100.

Figure 5:
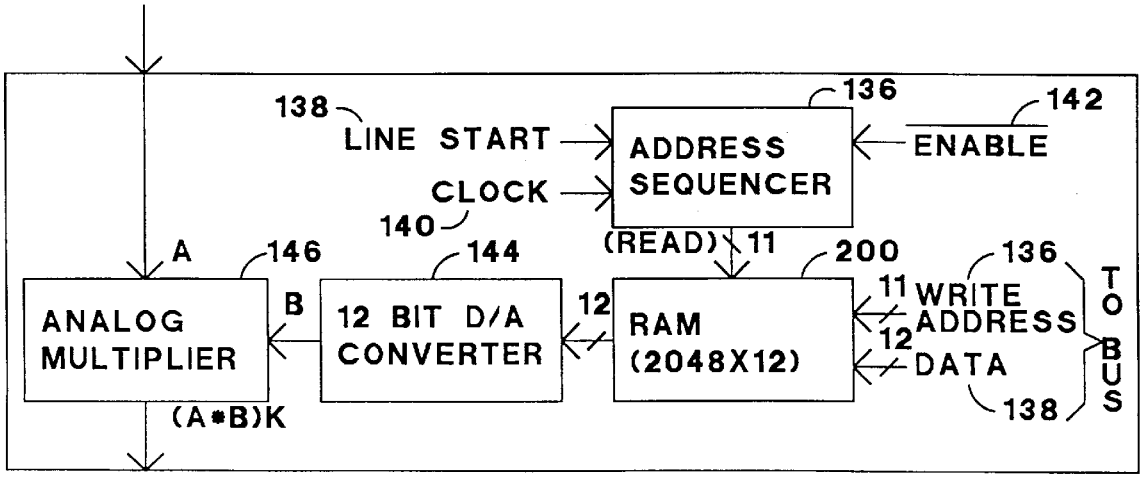
FIG. 5 is a block diagram of the normalizer of FIG. 4.

The red 106, green 108, and blue 110 color signals from each of the cameras 44 and 46 are transmitted to an analog-to-digital converter (A/D) module 130. The A/D module 130 includes three normalizers 132*a*, 132*b*, 132*c* to normalize each of the color signals and three analog-to-digital converters 134*a*, 134*b*, 134*c* to convert the normalized analog color signals to a digital format. The cameras view objects from a central location across a relatively wide view which results in light intensity variations in the observed light. The normalizers 132*a*–132*c* are designed to compensate for light intensity variations across the view of the camera in a conventional manner. Referring to FIG. 5, each normalizer 132*a*–132*c* receives a respective analog input signal representative of a particular color. A random access memory (RAM) 200, preferably 2048×12, is addressed by the computer 106, via the bus 108, with write address lines 136 and data lines 138 to load compensation data into the RAM 200. The compensation data is representative of the gain necessary to compensate each pixel for anticipated light intensity variations. An address sequencer 136 is controlled by a line start signal 138, clock signal 140, and enable signal (active low) 142 to address the data within the RAM 200 corresponding to the respective analog signal currently being transmitted to the normalizer. The analog color signals are sequentially transmitted to the normalizer by the camera so the gain compensation data is likewise addressed in a sequential manner. The RAM 200 transmits digital data to a digital-to-analog converter 144 which produces a corresponding analog output signal. The analog output of the digital-to-analog convertor 144 and the analog color signal received by the normalizer are multiplied together by an analog multiplier 146. The output of the analog multiplier 146 is transmitted to a respective A/D converter 134*a*–134*c*. The outputs 150*a*–150*c* of the analog-to-digital converters 134*a*–134*c* are inputs to the converter module 170. In summary, each normalizer multiplies the analog color signals of each pixel by a particular gain factor for that pixel determined during calibration. Each normalizer circuit 132*a*–132*c* is identical except for different compensation data, if necessary. The timing. for the addressing of the address sequencer 136 is controlled from the TG module 102.

To reduce the data processing requirements, make the system insensitive to light intensity variations, intuitive for operators to adjust the acceptable color content, and reduce the training required for operators, the color signals are transformed by the convertor 170 to a hue signal 152, a saturation signal 154, and an intensity signal 156. The combination of the hue, saturation, and intensity is known conventionally as a HSI model. The HSI model may also be known as hue-saturation-luminescence model, hue-saturation-brightness model, hue-saturation-value model, etc. In general, the HSI model is based on the intuitive appeal of the "hue", which is a definition of the actual color, such as red, orange, yellow, blue-green, etc. The "saturation" is a definition of how pure the color is, and may be considered a measure of how densely the hue is spread on a white background. The "intensity" is a definition of the amount of light reflected from an object. The HSI color space model, as opposed to the red-green-blue model, relates more closely to the colors of human perception so that operator adjustments are more intuitive.

Referring to FIGS. 6A and 6B, representation of the HSI model can be a cylindrical coordinate system, and the subset of the space within which the model is defined as a cone, or circled pyramid. The top of the cone corresponds to I=1, which contains the relatively bright colors. The colors of the I=1 plane are not all the same perceived brightness, however. The hue H is measured by the angle around the vertical axis, with red at 0°, green at 120°, and so on. Complementary colors in the HSI circle are 180° opposite one another. The value of saturation S is a ratio ranging from 0 on the center line I axis to 1 on the triangular sides of the cone. Saturation is measured relative to the color gamut represented by the model, which is a subset of the entire CIE chromaticity diagram. Therefore, saturation of 100 percent in the model is less than 100 percent excitation purity.

The cone is one unit high in I, with the apex at the origin. The point at the apex is black and has an I coordinate of 0. At this point, the values of H and S are irrelevant. The point S=0, I=1 is white. Intermediate values of I for S=0 on the center line are the grays. When S=0, the value of H is irrelevant (called by convention UNDEFINED). When S is not zero, H is relevant. For example, pure red is at H=0, S=1, I=1. Indeed, any color with I=1, S=1 is akin to an artist's pure pigment used as the starting point in mixing colors. Adding white pigment corresponds to decreasing S without changing I. Shades are created by keeping S constant and decreasing I. Tones are created by decreasing both S and I. Of course, changing H corresponds to selecting the pure pigment with which to start. Thus, H, S, and I correspond to concepts from the artists color system. Foley, et al., *Computer Graphics Principles and Practice*, Second Edition, Chapter 13, discloses both an HSI color model and one algorithm to obtain the HSI color model from a RBG color model, and is incorporated herein by reference.

Referring to FIG. 7, the converter 170 converts the red 150*c*, green 150*b*, and blue 150*a* color values to a hue 152, a saturation 154, and an intensity 156 value. The converter 170 has three main components, namely, a Bt281 Integrated Circuit 172, available from Brooktree, and two look up tables 174 and 176. The tables 174 and 176 include address, data, and control lines (not shown). The Bt281 is a programmable matrix multiplier designed specifically for image capture and processing applications. The Bt281 includes operational controls, such as, address and control lines, data lines, and an output enable (not shown). The 3×3 matrix in the Bt281 is programmed with the following values:

$$\begin{bmatrix} 1 & -0.5 & -0.5 \\ 0 & 0.866 & -0.866 \\ .333 & 0.866 & 0.333 \end{bmatrix} \begin{bmatrix} R \\ B \\ G \end{bmatrix} = \begin{bmatrix} H_x \\ H_y \\ I \end{bmatrix}$$

The red, green, and blue color values 150*a*–150*c* are multiplied by the Bt281 internal 3×3 matrix to obtain three outputs, namely $H_x$, I, and $H_y$. The intensity is output I which is calculated by adding one third of each of the red, green, and blue color signals together. A first intermediate signal $H_x$ is equal to the red value minus half the blue and green values. A second intermediate signal $H_y$ is equal to 0.866* blue value minus 0.866* green value. The first intermediate value $H_x$ and second intermediate value $H_y$ are inputs to the first RAM look-up table 174 to obtain the hue signal. The data in the table 174 computes the following relation: Arctan ($H_Y/H_x$). The max/min block 180 determines the maximum and minimum of the three color signals and generates two outputs, namely, max-min 182 and max 184. The second RAM look-up table 176 contains data that corresponds to computing the following relation: (Max-Min)/Max. The output of table 176 is the saturation value.

Alternative electronic components, software, or alternative methodologies may likewise be used to compute values representative of the hue, saturation, and intensity. The entire system may also be analog, if desired.

Transforming the color signals to a hue range from red to blue (through green) makes it possible to sort objects having a wide range of colors. Additionally, by including the capability of obtaining the blue hue from the converter module 170 the saturation and intensity values may be computed. The intensity is a value indicative of the amount of light received and typically does not directly relate to the actual color of the object. Accordingly, the remaining hue and saturation values may be used alone to classify and sort objects. The combination of the hue and saturation values allows greater color recognition, than do hue values alone, in determining whether an object is acceptable or should be rejected. Further, with only two variables the data processing requirements are manageable.

Figure 8:
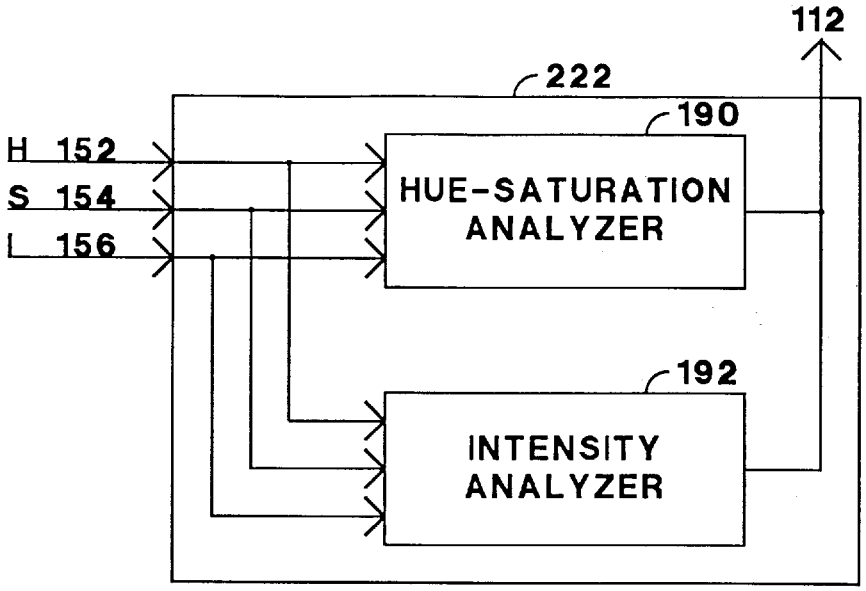
FIG. 8 is a block diagram of the analyzer of FIG. 4.

Referring to FIG. 8, the analyzer module 222 includes two main components, namely, a hue-saturation analyzer 190, and an intensity analyzer 192. The hue-saturation analyzer 190 assigns a unique identification number to each hue and saturation combination. The identification number corresponds to an address in a memory map where data represents either an acceptable object or one that is not acceptable. In response to an unacceptable object a signal 112 is transmitted to the ejector 38 to reject unacceptable objects. In all, from a very large volume of data received from the camera, (255×255×255×2048) bytes per scan, the analyzer 190 only compares a maximum of 2048 different values. With only 2048 different data combinations, fast analysis of objects is feasible, permitting an increase in the number of objects that can be scanned within the same time period. However, if the minimum acceptable blemish is greater in size than a single pixel, the system may require a predetermined number of sequential blemish images before the object is considered unacceptable.

The arctan function used to compute the hue has a range of 90°. However, a color range of 90° is insufficient to properly enhance the colors of objects with different colors. The output of the arctan function has values ranging from −45° to +45°. For convenience, 45° is added to the output to shift the result to values from 0° to 90°. However, both Hx and Hy can be negative, which indicates that a different quadrant should be selected in such case to properly enhance colors. If Hx is negative then the hue should be represented in the next quadrant. Accordingly, 90° is added to the result when Hx is negative so that the next quadrant values do not overlap the first quadrant. The result is a range of values from 0° to 180° which automatically enhances the appropriate colors. The 0 to 180 degree range is scaled to a 0 to 240 degree range to accommodate an 8 bit system. The remaining values from 241 to 256 are reserved for control and error checking functions.

The analyzer includes an intensity module 192. When the color values are such that red=green=blue, the saturation and hue are both undefined corresponding to a shade of gray. Also, as the saturation value approaches zero it becomes increasingly undefined and is not a reliable indicator to use in sorting. Accordingly, a threshold value is incorporated into the intensity module 172 which triggers the use of the threshold module 172 when the saturation value or the difference between two or three of the colors is lower than a threshold value. When this condition occurs, the intensity value is used, as opposed to the hue and saturation, to determine if the product is acceptable or should be rejected. Thus, the intensity module 172 accounts for those conditions when the data is undefined or unreliable.

Figure 9:
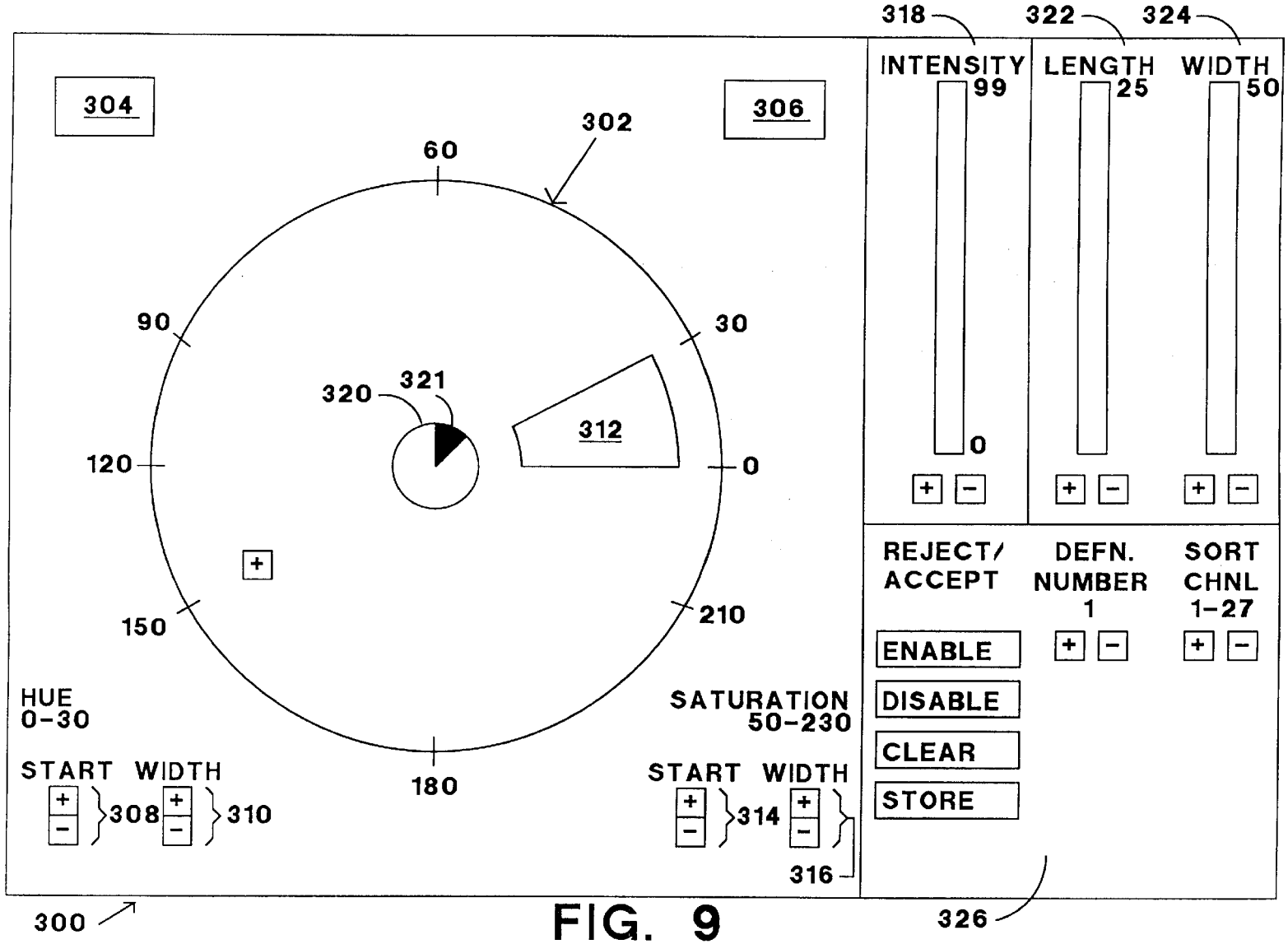
FIG. 9 is an illustrative diagram of an operator display.

Referring to FIG. 9 the operator display 300 includes a graphical representation of the hue, saturation, and intensity classification criteria for objects. The display 300 includes a color wheel 302 which defines acceptable or rejectable hue values in an angular manner around the color wheel, with values between 0 and 240. The color wheel 302 defines acceptable or rejectable saturation values as distances along a radii of the color wheel 302. A hue of 0 is a red color, a hue of 80 is a green color, and a hue of 160 is a blue color. By selecting the define accept button 304 or define reject button 306 the operator can select whether regions defined on the color wheel 302 indicate acceptable or objects to be rejected, respectively. The start buttons 308 and width buttons 310 are used to define the hue range (arc on the color wheel 302) of a region 312. The start buttons 314 and width buttons 316 are used to define the saturation range (distances on the radii of the color wheel) of the region 312. Additional regions may be defined on the color wheel 302 to indicate additional acceptable or reject objects. The threshold value for the intensity sorting criteria is selected with the intensity selector 318. The value selected by the intensity selector 318 is illustrated on the color wheel 302 as the diameter of a central circular region 320. When the central region 320 is selected, the start buttons 308 and width buttons 310 are used to select the acceptable shades of grey as indicated by the darkened area 321 within the central region. In addition a length selector 322 and width selector 324 may be used to further define the width and length required for acceptable or rejectable objects within one or more regions 312. The control section 326 is used to store, retrieve, disable, and enable different predefined patterns on the color wheel 302. Further, a set of patterns can be used for multiple lanes (sort channels) of products in order allow simultaneous sorting of multiple different types of objects, each with a different classification criteria. The color sorter also includes a capture facility whereby an image of an object can be captured on the display and its color content displayed on the color wheel to assist the operator in defining that object as acceptable or rejectable. Overall, the display 300 allows the intuitive selection of classification criteria for objects in order to reduce the training required for operators.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of classifying an object comprising the steps of:

(a) sensing a multiple color image of at least a portion of said object while said object is moving;

(b) producing color signals from said multiple color image indicative of a plurality of colors in response to sensing said multiple color image;

(c) transforming said color signals from said multiple color image sensed while said object is moving to a hue signal and a saturation signal; and (d) variably classifying said object depending upon said hue signal and said saturation signal.

2. The method of claim 1, further comprising the steps of:

(a) providing a memory containing data representative of hue and saturation values; and (b) classifying said object by comparing both said hue signal and said saturation signal to said data.

3. The method of claim 1, further comprising the step of sensing said multiple color image with a plurality of cameras.

4. The method of claim 1, further comprising the step of sensing said multiple color image with a single camera.

5. The method of claim 1, further comprising producing color signals substantially indicative of at least red, blue, and green.

6. The method of claim 1, further comprising producing color signals substantially indicative of at least one of ultraviolet, x-ray, and infrared.

7. The method of claim 1, further comprising producing color signals substantially indicative of multiple color image at multiple ranges of colors.

8. The method of claim 1, further comprising the step of sensing respective multiple color images of respective portions of a plurality of objects.

9. The method of claim 1, further comprising the step of producing said color signals in one composite signal.

10. The method of claim 1, further comprising the step of classifying said object as either acceptable or rejected.

11. The method of claim 1, further comprising the step of classifying said object into a grade of objects.

12. The method of claim 1, further comprising the step of transforming said color signals to said hue signal within a predetermined range of hue values.

13. The method of claim 12, further comprising the step of transforming said color signals to said hue signal within a range of hue values from substantially red to substantially blue.

14. The method of claim 13, further comprising the step of transforming said color signals to said hue signal within a range of hue values greater than from substantially red to substantially green.

15. A method of classifying an object comprising the steps of:

(a) randomly positioning said object at any location across a major portion of the width of a tray where said major portion is a continuous region of potential locations for said object;

(b) sensing a multiple color image of at least a portion of said object while said object is moving and randomly positioned;

(c) producing color signals from said multiple color image indicative of a plurality of colors in response to sensing said multiple color image;

(d) transforming said color signals from said multiple color image sensed while said object is moving to a hue signal; and (e) variably classifying said object depending upon said hue signal.

16. The method of claim 15, further comprising the steps of:

(a) providing a memory containing data representative of hue values; and (b) variably classifying said object by comparing said hue signal to said data.

17. The method of claim 15, further comprising the steps of:

(a) transforming said color signals to a saturation signal; and (b) variably classifying said object depending upon said hue signal and said saturation signal.

18. The method of claim 17, further comprising the steps of:

(a) providing a memory containing data representative of saturation and hue values; and (b) variably classifying said object by comparing both said hue signal and said saturation signal to said data.

19. The method of claim 15, further comprising producing color signals substantially indicative of at least red, blue, and green.

20. The method of claim 15, further comprising producing color signals substantially indicative of at least one of ultraviolet, x-ray, and infrared.

21. The method of claim 15, further comprising producing color signals substantially indicative of multiple ranges of colors.

22. The method of claim 15, further comprising the step of sensing respective multiple color images of respective portions of a plurality of objects.

23. The method of claim 15, further comprising the step of producing said color signals in one composite signal.

24. The method of claim 15, further comprising the step of classifying said object as either acceptable or rejected.

25. The method of claim 15, further comprising the step of classifying said object into a grade of objects.

26. The method of claim 15, further comprising the step of transforming said color signals to said hue signal within a predetermined range of hue values.

27. The method of claim 15, further comprising the step of transforming said color signals to said hue signal within a range of hue values from substantially red to substantially blue.

28. A method of classifying an object comprising the steps of:

(a) sensing a multiple color image of the same minor portion of said object;

(b) producing color signals from said multiple color image indicative of a plurality of colors in response to sensing said multiple color image;

(c) transforming said color signals to a set of values, said set including at least one value representative of at least one of a hue signal and a saturation signal corresponding to said minor portion independently of the remainder of said object; and (d) variably classifying said object depending upon said set independently of the remainder of said object.

29. The method of claim 28, further comprising the steps of:

(a) providing a memory containing a reference set of at least one of hue data and saturation data corresponding to said set; and (b) classifying said object by comparing said set to said reference set.

30. The method of claim 28, further comprising the step of sensing said multiple color image with a plurality of cameras.

31. The method of claim 28, further comprising the step of sensing said multiple color image with a single camera.

32. The method of claim 28, further comprising producing color signals substantially indicative of at least red, blue, and green.

33. The method of claim 28, further comprising producing color signals substantially indicative of at least one of ultraviolet, x-ray, and infrared.

34. The method of claim 28, further comprising producing color signals substantially indicative of multiple color image at multiple ranges of colors.

35. The method of claim 28, further comprising sensing respective multiple color images of respective portions of a plurality of objects.

36. The method of claim 28, further comprising the step of producing said color signals in one composite signal.

37. The method of claim 28, further comprising the step of classifying said object as either acceptable or rejected.

38. The method of claim 28, further comprising the step of classifying said object into a grade of objects.

39. The method of claim 28, further comprising the step of transforming said color signals to said hue signal within a predetermined range of hue values.

40. The method of claim 28, further comprising the step of transforming said color signals to said hue signal within a predetermined range of hue values from substantially red to substantially blue.

41. A method of classifying an object comprising the steps of:

(a) sensing a multiple color image of at least a portion of said object while said object is moving;

(b) producing color signals from said multiple color image indicative of a plurality of colors in response to sensing said multiple color image;

(c) transforming said color signals from said multiple color image sensed while said object is moving to a hue signal within a predetermined range of values from at least substantially red to substantially blue; and (d) variably classifying said object depending upon said hue signal.

42. The method of claim 41, further comprising the steps of:

(a) transforming said color signals to a saturation signal; and (b) variably classifying said object depending upon said saturation signal.

43. The method of claim 41, further comprising the steps of:

(a) providing a memory containing data representative of hue values; and (b) variably classifying said object by comparing said hue signal to said data.

44. The method of claim 42, further comprising the steps of:

(a) providing a memory containing data representative of hue values and saturation values; and (b) variably classifying said object by comparing said hue signal and said saturation signal to said data.

45. A method of classifying an object comprising the steps of:

(a) sensing a multiple color image of at least a portion of said object;

(b) producing color signals indicative of a plurality of colors in response to sensing said multiple color image;

(c) transforming said color signals to a hue signal having an angular component representative of a selected quadrant of a cartesian coordinate system;

(d) selecting said quadrant in response to sensing said multiple color image so as to enhance the desired color; and (e) variably classifying said object depending upon said hue signal.

46. A method of classifying an object comprising the steps of:

(a) sensing a multiple color image of at least a portion of said object;

(b) producing color signals indicative of a plurality of colors in response to sensing said multiple color image;

(c) comparing at least two of said color signals to determine the difference between said at least two color signals;

(d) transforming said color signals to an intensity signal if said difference is less than a predetermined threshold value; and (e) variably classifying said object depending upon said intensity signal.

47. The method of claim 46, further comprising the steps of:

(a) transforming said color signals to a hue signal and a saturation signal if said difference is not less than a predetermined threshold value; and (b) variably classifying said object depending upon said hue signal and said saturation signal.

48. A method of classifying an object comprising the steps of:

(a) sensing a multiple color image of at least a portion of said object;

(b) producing color signals indicative of a plurality of colors in response to sensing said multiple color image;

(c) transforming said color signals to a saturation signal and an intensity signal; and (d) variably classifying said object depending upon said intensity signal if said saturation signal is less than a predetermined threshold value.

49. The method of claim 48, further comprising the steps of:

(a) transforming said color signals to a hue signal if said saturation signal is not less than said predetermined threshold value; and (b) variably classifying said object depending upon said hue signal and said saturation signal.

50. A method of classifying an object comprising the steps of:

(a) sensing a multiple color image of at least a portion of said object;

(b) producing color signals indicative of a plurality of colors in response to sensing said multiple color image;

(c) transforming said color signals to a hue signal and a saturation signal;

(d) producing an output indicative of said hue signal and said saturation signal;

(e) modifying classification criteria in response to said output; and (f) variably classifying said object depending upon said hue signal and said saturation signal in accordance with said modified classification criteria.

51. A method of classifying an object comprising the steps of:

(a) sensing a multiple color image of at least a portion of said object;

(b) producing color signals indicative of a plurality of colors in response to sensing said multiple color image;

(c) transforming said color signals to a hue signal and a saturation signal; and (d) variably classifying said object depending upon said hue signal and said saturation signal independently of an intensity signal.

52. The method of claim 51, further comprising the steps of:

(a) providing a memory containing data representative of hue and saturation values; and (b) classifying said object by comparing both said hue signal and said saturation signal to said data.

53. The method of claim 51, further comprising the step of sensing said multiple color image with a plurality of cameras.

54. The method of claim 51, further comprising the step of sensing said multiple color image with a single camera.

55. The method of claim 51, further comprising producing color signals substantially indicative of at least red, blue, and green.

56. The method of claim 51, further comprising producing color signals substantially indicative of at least one of ultraviolet, x-ray, and infrared.

57. The method of claim 51, further comprising producing color signals substantially indicative of multiple color image at multiple ranges of colors.

58. The method of claim 51, further comprising the step of sensing respective multiple color images of respective portions of a plurality of objects.

59. The method of claim 51, further comprising the step of producing said color signals in one composite signal.

60. The method of claim 51, further comprising the step of classifying said object as either acceptable or rejected.

61. The method of claim 51, further comprising the step of classifying said object into a grade of objects.

62. The method of claim 51, further comprising the step of transforming said color signals to said hue signal within a predetermined range of hue values.

63. The method of claim 62, further comprising the step of transforming said color signals to said hue signal within a range of hue values from substantially red to substantially blue.

64. The method of claim 63, further comprising the step of transforming said color signals to said hue signal within a range of hue values greater than from substantially red to substantially green.

* * * * *